United States Patent [19]

Urra Martinez

[11] Patent Number: 5,005,837

[45] Date of Patent: Apr. 9, 1991

[54] GOLF TRAINER

[76] Inventor: Pedro M. Urra Martinez, Padre Moret, 10-2°, Pamplona, Spain, 31002

[21] Appl. No.: 508,659

[22] Filed: Apr. 13, 1990

[30] Foreign Application Priority Data

Apr. 13, 1989 [ES] Spain ..... 8901290

[51] Int. Cl.[5] ..... A63B 69/36

[52] U.S. Cl. ..... 273/195 B; 273/176 H

[58] Field of Search ..... 273/176 H, 195 A, 195 B, 273/183 A, 187 R, 187 B

[56] References Cited

U.S. PATENT DOCUMENTS

| | | | |
|---|---|---|---|
| 2,937,875 | 5/1970 | Mason et al. | 273/195 B |
| 3,633,918 | 1/1972 | Smiley | 273/195 A |
| 3,693,979 | 9/1972 | Koett | 273/176 H |
| 3,869,127 | 3/1975 | Kohori | 273/195 B |

FOREIGN PATENT DOCUMENTS

| | | | |
|---|---|---|---|
| 8700045 | 2/1987 | Fed. Rep. of Germany | 273/195 B |
| 2587627 | 3/1987 | France | 273/195 B |

*Primary Examiner*—Geroge J. Marlo

*Attorney, Agent, or Firm*—Fleit, Jacobson, Cohn, Price, Holman & Stern

[57] ABSTRACT

A golf trainer characterized by a ground support (4) having a ring (6) on which is positioned a ring (3), with the inclusion of bearings formed as slide runners (12) between the two rings (3) (6) to permit the selective turning of the upper ring (3) with respect to the lower (6) about a substantially vertical axis, the upper ring (3) being attached by means of pivots (7), to a base or platform (1) which may thus tilt, from a position parallel to the ground to an inclined position, so that the base or platform (1) may turn and moreover may be inclined with respect to the ground.

5 Claims, 2 Drawing Sheets

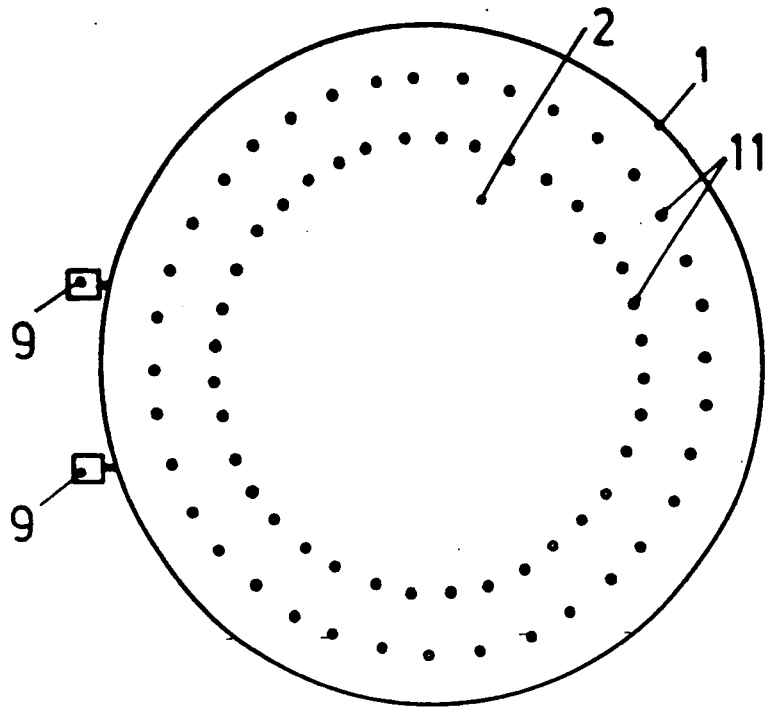
Fig.5
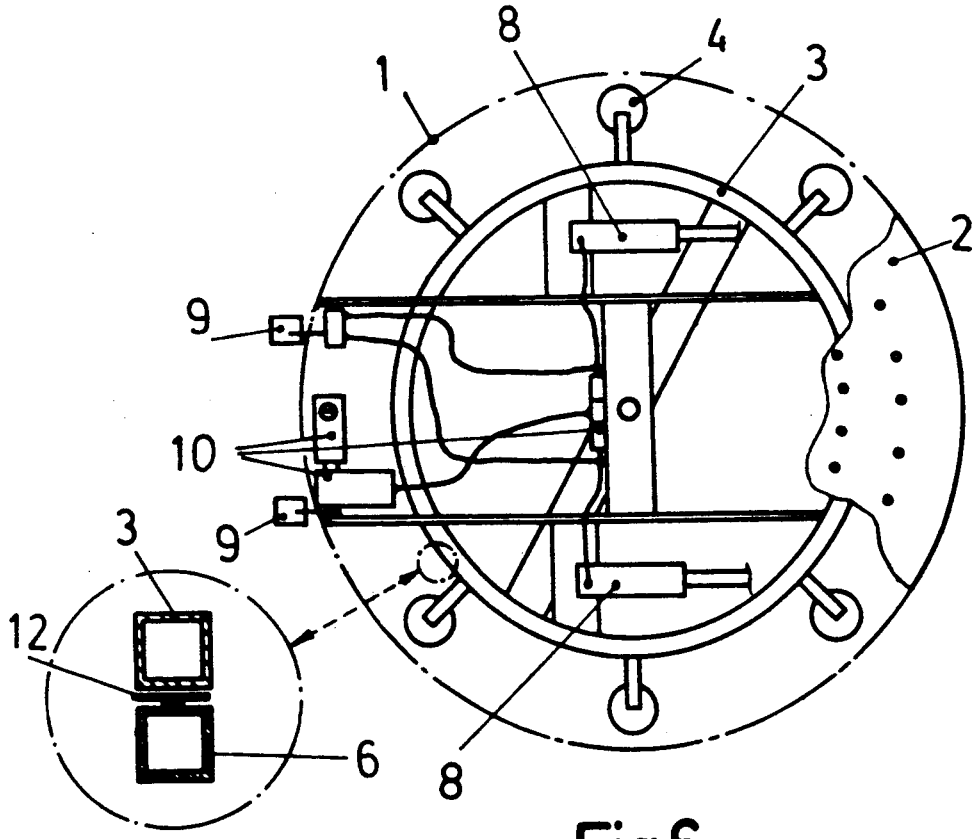
Fig.7
Fig.6

GOLF TRAINER

The invention relates to a golf trainer.

In training for the game of golf it is necessary that the player should be able to make successive strokes, sending the balls in a simulation of what will later be a normal development of the game. Until now golf courses which are equipped with practice areas have had what is commonly called matting, since it consists of a mat on which the player places himself and addresses the ball, in order to make a shot.

This solution does not offer adequate training conditions, since the matting is always in the same position with respect to the level of the ground, resting directly on it, so that the player cannot train in all varieties of shots which exist, such as high ball, low ball, uphill lie, downhill lie, etc., since the mat does not reproduce the different varieties of unevenness and direction which the natural terrain offers in a real game.

Attempts to obtain a matting whose planar positioning is changeable with respect to the ground have failed since they have entailed solutions of great structural complexity, unfit for general application and moreover, such complexity entails very bulky products.

Training devices are known which have worked by placing the matting on the base of an inverted cone, whose turning about its own apex, and oscillation with respect to its height could translate into the positioning of said base in planes of different inclination and direction, but this solution entailed structures of a height unsuitable for good training.

The object of the present invention is to provide a training platform which achieves all the possible directions within a rotation of three hundred and sixty degrees and different inclinations between a maximum pre-established slope and level, all this with a simple device and of minimum height.

According to the invention there is provided a golf trainer characterised by a user platform supported on a ground support and by means for permitting rotation of the platform about a substantially vertical axis and means for adjusting the plane of the platform between the horizontal and an inclined position.

In a preferred embodiment the golf trainer is characterised by a ground support having a ring on which is positioned a ring, with the inclusion between the two of bearing means to permit the selective turning of the upper ring with respect to the lower about a substantially vertical axis, the upper ring being attached by means of pivots, to a base or platform which may thus tilt from a position parallel to the ground to an inclined position, so that the base or platform may turn and moreover may be inclined with respect to the ground.

Preferably the golf trainer is characterised by matting or the like on the base or platform, the matting being formed with depressions for locating golf balls. Preferably the matting is of the same colour as the playing terrain and incorporates peripheral indicators comprising different coloured arcs.

If desired the tilting of the base or platform may be effected by means of at least one, e.g. a pair of cylinders e.g. hydraulic jacks, capable of stably supporting the base or platform with the player positioned on it at the preselected inclination.

In order to better understand the nature of the invention, in the accompanying drawings we show, by way of example, a preferred form of industrial realisation, to which we refer in the following description, and in which:

FIG. 5 is a view from above of the platform of the invention;

FIG. 6 is a view as in FIG. 5, but with the base partially sectioned in order to see the internal mechanisms, the general outline of the base (1) having been shown in lines and dotted lines, and FIG. 7 shows in detail a transverse section of the rings (3 and 6).

Clarifying details

Figure 1:
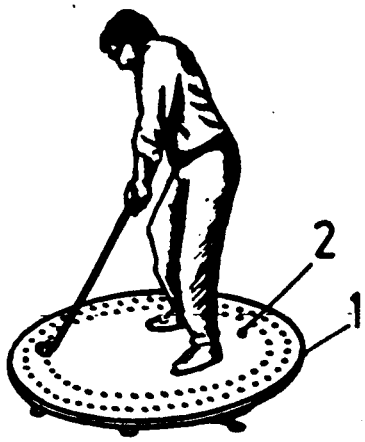
FIGS. 1 and 2 show schematically a player positioned on the platform or base (1) of the present invention, in different positions.
Figure 2:
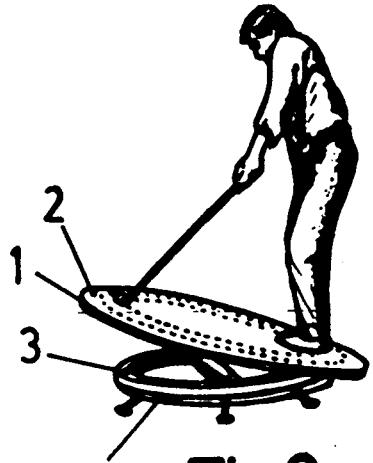

1. Base or platform
2. Matting
3. Upper ring
4. Ground Support Feet
5. Ground
6. Lower ring
7. Pivot
8. Cylinders
9. Pedals
10. Valves
11. Depressions
12. Slide bearings A trainer for practising the game of golf comprises a base or platform (1), positioned on and joined to a circumferential frame or ring (3), situated in its turn on a circumferential frame or lower ring (6). The lower ring (6) has feet (4) for supporting it on the ground (5).

Between both rings (3 and 6) are placed bearings formed as slide runners (12), such as can be seen in FIG. 7. These runners (12), made, for example, from Teflon, Registered Trade Mark, permit the upper ring (3) to turn on the lower ring (6), through an angle of up to three hundred and sixty degrees.

In this way, the base (1), fixed to the upper ring (3), can turn radiallY about the central point of the platform, at any angle between zero and three hundred and sixty degrees and including successive complete turns.

Figure 3:
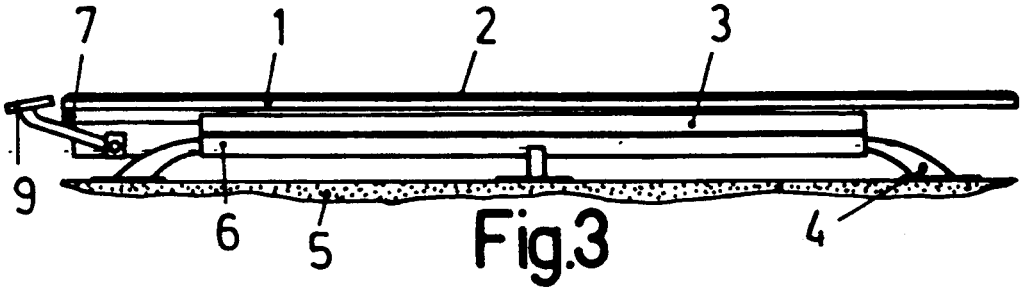
FIG. 3 is a side elevation view with the base (1) parallel with the ground (5)
Figure 4:
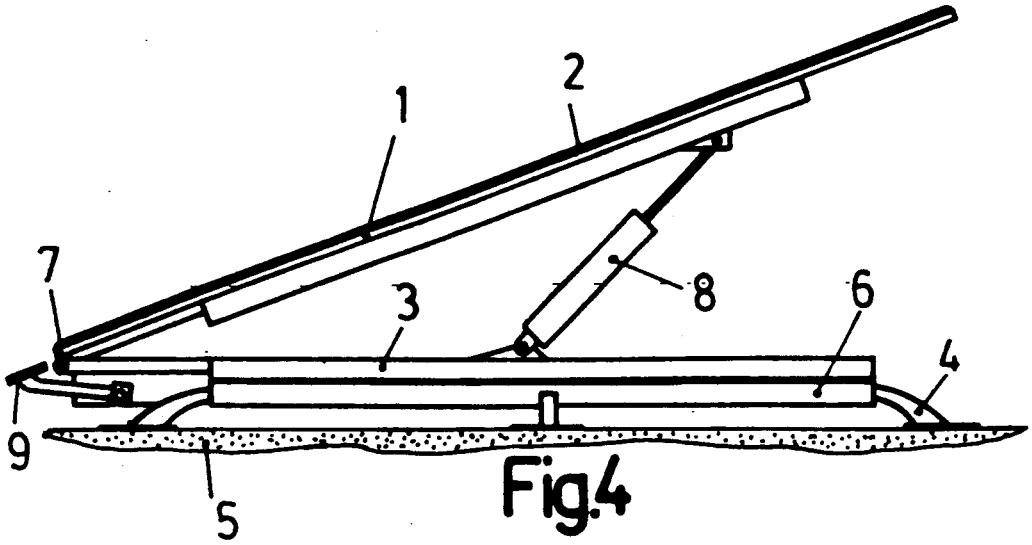
FIG. 4 is a view as in FIG. 3, but with the base (1) positioned with the maximum inclination.

The connection between the upper ring (3) and the base (1) is established by a pivot shaft (7), see FIG. 4, in such a way that the upper ring (3) always remains parallel to the lower ring (6) and consequently parallel to the ground (5), while the base (1) may pass from a position of zero inclination, in which it remains parallel to the ground, as shown in FIG. 3, to a position of maximum inclination in which it is inclined with reference to the plane of the ground (5), as can be seen in FIG. 4.

In order that the base (1) may pass from the zero position of inclination to that of maximum inclination, passing through anY of the possible intermediate positions, there is provided a mechanism from from two hydraulic piston and cylinder devices (8) governed by way of a pair of pedals (9), with respective valve mechanisms (10); all this so that on pushing on one of the pedals (9), each push leads to a certain elevation of the base (1). Thus, on reaching the desired inclination, the action of pushing on the pedal (9) is stopped and the base (1) will remain established in said position allowing the player to mount it.

If it is wished that the base (1) should go down it is sufficient to tread on the other pedal (9) for the base (1) to start its progressive descent which will continue until the pressure on this pedal (9) is released or until the position of total descent shown in FIG. 3 has been reached.

In this way, the golfer will raise the base (1) until it reaches the desired inclination and will turn said base (1), until positioned in the direction required, a procedure which may be the other way round, in order to mount the base (1) thereafter and make the corresponding golf training shots.

Thus the platform of minimum height and very simple structure, permits the adoption of all possible positions, both of azimuth and of inclination, to simulate as far as possible the irregularities and unevenness of the terrain in a real game.

It is obvious that the base (1) may have different dimensions and shapes without changing the invention, the circular shape being preferred in order to avoid peripheral points of reference for the player. Likewise, the elevation mechanism, formed from cylinders (8), can be made by other means within the current art, such as screw jacks, racks, etc., without altering in any way the essence of the invention.

In this sense, it is envisaged that the platform may be automated, so that it incorporates a motor-pump unit governed by computerised programme, so that the player only has to set on a screen the values of inclination and azimuth in order that the base (1) may automatically adopt the position selected.

On the other hand, it is envisaged that on the base (1) there should be matting (2) of a synthetic material, preferably green in colour similar to the playing ground, in order to achieve the maximum similarity possible to the development of a real game. The positioning of the matting (2) will be such that it allows the removal and substitution thereof, due to wear and tear, for cleaning, etc. On the matting (2) are provided a series of depressions (11), in the shape of concavities, in order to place the ball therein and so that the latter does not roll on the matting (2) when the base (1) is in an inclined position. Also it is envisaged that on the outside or periphery of the matting (2) there may be provided some different coloured arc-shaped strips, so that the player may thus have points of reference.

I claim:

1. A golf trainer characterised by a ground support (4) having a lower ring (6) on which is positioned an upper ring (3), parallel to the lower ring, with the inclusion between the two rings of bearing means to permit selective turning of the upper ring (3) with respect to the lower ring (6) about a substantially vertical axis, the upper ring (3) being attached by means of pivot (7), to a platform (1) which may thus tilt, from a position parallel to the rings to an inclined position, so that the platform (1) may turn and may be inclined with respect to the ground and tilt means being provided between the upper ring and the platform for selectively tilting the platform with respect to the upper ring.

2. A golf trainer according to claim 1 characterised by matting (2) on the platform (1) and formed with depressions (11) for locating golf balls.

3. A golf trainer as defined in claim 1 wherein the tilt means comprises a pressure cylinder assembly connected between the platform and the upper ring.

4. A golf trainer as defined in claim 3 including a foot pedal for operating the cylinder assembly to raise the platform by repeatedly pushing on the foot-pedal.

5. A golf trainer as defined in claim 4 including a further foot pedal for operating the cylinder assembly to lower the platform by pushing on the further pedal.

* * * * *